US010975659B2

(12) United States Patent
Jordan

(10) Patent No.: US 10,975,659 B2
(45) Date of Patent: Apr. 13, 2021

(54) AUTOMATIC BLANKING COMPLETION TOOL

(71) Applicant: Zenith Oilfield Technology Limited, Inverurie (GB)

(72) Inventor: Leslie Eric Jordan, Inverurie (GB)

(73) Assignee: ZENITH OILFIELD TECHNOLOGY LIMITED

( * ) Notice: Subject to any disclaimer, the term of this patent is extended or adjusted under 35 U.S.C. 154(b) by 563 days.

(21) Appl. No.: 14/888,223

(22) PCT Filed: May 1, 2014

(86) PCT No.: PCT/GB2014/051366
§ 371 (c)(1),
(2) Date: Oct. 30, 2015

(87) PCT Pub. No.: WO2014/177881
PCT Pub. Date: Nov. 6, 2014

(65) Prior Publication Data

US 2016/0076336 A1 Mar. 17, 2016

(30) Foreign Application Priority Data

May 1, 2013 (GB) ..... 1307904.1

(51) Int. Cl.
*E21B 34/08* (2006.01)
*E21B 43/12* (2006.01)

(52) U.S. Cl.
CPC ..... *E21B 34/08* (2013.01); *E21B 43/128* (2013.01)

(58) Field of Classification Search
CPC ..... E21B 17/18; E21B 34/08; E21B 43/128
See application file for complete search history.

(56) References Cited

U.S. PATENT DOCUMENTS 5,975,209 A * 11/1999 McCorry ..... E21B 23/002 166/242.3
6,497,278 B1 * 12/2002 Norris ..... E21B 34/066 166/242.3

(Continued)

FOREIGN PATENT DOCUMENTS

EP 2088279 A2 8/2009
GB 2327961 A 2/1999

(Continued)

OTHER PUBLICATIONS

International Search Report and Written Opinion dated Mar. 5, 2015 which was issued in connection with PCT Patent Application No. PCT/GB2014/051366 which was filed on May 1, 2014.

(Continued)

*Primary Examiner* — Matthew R Buck
(74) *Attorney, Agent, or Firm* — Baker Hughes Patent Operation

(57) ABSTRACT

A differential pressure-operated blanking completion tool for use at a Y-Block with an electrical submergible pump (ESP) in oil or other wells. The tool has a body having an inlet and first and second outlets, the outlets being arranged in parallel and opposite the inlet; a support member located between the outlets; a sealing element mounted on the support member and rotatable with respect to the support member, the element including a substantially spherical surface; and wherein the support member is pivoted between the outlets to bring a fresh sealing surface into contact with either outlet and thereby selectively seal the respective outlet and prevent fluid flow therethrough.

20 Claims, 4 Drawing Sheets

(56) References Cited

U.S. PATENT DOCUMENTS

| | | | | |
|---|---|---|---|---|
| 6,508,308 | B1 * | 1/2003 | Shaw | E21B 23/002 166/105 |
| 7,431,093 | B2 * | 10/2008 | Bearden | E21B 41/02 166/105 |
| 8,104,540 | B2 * | 1/2012 | Leitch | E21B 23/002 166/105.4 |

FOREIGN PATENT DOCUMENTS

| | | | | |
|---|---|---|---|---|
| GB | 2391242 | A | 2/2004 | |
| GB | 2395500 | C | 1/2011 | |
| WO | WO-9803766 | A1 * | 1/1998 | E21B 34/08 |
| WO | 2002075111 | A1 | 9/2002 | |

OTHER PUBLICATIONS

Great Britain Search Report dated Aug. 23, 2013 which was issued in connection with GB patent Application No. 1307904.1 which was filed on May 1, 2013.

* cited by examiner

AUTOMATIC BLANKING COMPLETION TOOL

BACKGROUND

The present invention relates to completion tools used with electrical submergible pumps (ESP) in oil and other wells where artificial lift is utilised to improve production. In particular, though not exclusively, the invention relates to an improved differential pressure-operated blanking completion tool for use at a Y-Block.

It is known in the field of oil and gas production to use artificial lift techniques to increase the flow rate of wells having a reduced bottomhole pressure. One method of artificial lift is to incorporate an ESP in the production tubing to pump the fluids to the surface of the well. The ESP can either be directly in the production tubing or located in parallel with bypass tubing. In this second arrangement a Y-Block is located in the production tubing wherein the ESP is supported from a first limb and the bypass tubing is supported from the second limb. The parallel arrangement is used when equipment needs to be run to a location below the ESP in the well.

When the ESP is operated, a blanking plug must be installed in the bypass tubing to prevent pumped fluids from being re-circulated through the by-pass tubing back into the well. A disadvantage of use of a blanking plug is that in normal operations, a shut down of the pump would allow the fluid column in the production tubing above the Y-Block to drain back through the pump, possibly causing reverse rotation of the pump and allowing sand to settle in the pump—neither of which is desirable.

A further disadvantage is that the blanking plug must be run-in on wireline or coiled tubing when required and pulled when the pump is switched on. These are time consuming and thus expensive interventions.

An automatic blanking completion tool has been proposed in GB 2 327 961 which prevents the fluid column draining through the ESP. This tool is in the form of a modified Y-Block which automatically seals the ESP, when the ESP is switched off, and seals the bypass when the ESP is running. This tool operates on the differential pressure between the bypass tubing and the ESP. A hinged flapper is mounted in the Y-Block at the point where the two limbs meet. The flapper is biased towards an open position where a first face of the flapper covers and seals the access to the ESP. When the ESP is switched on, the increase in pressure, forces the flapper over so that the opposing face covers and seals the access to the bypass tubing. Additionally when the ESP is switched off, the bias will return the flapper so that the first face again seals the access to the ESP. As fluid pressure operates the tool, no intervention is required and the tool is automatic.

A disadvantage of this differential pressure-operated blanking completion tool is that the flapper deteriorates with use and as soon as one of the faces is eroded or becomes misshapen, the sealing capabilities are lost. Without a seal, a pressure-differential cannot be effectively created between the opposing faces and the flapper will not move. The entire completion tool must then be removed from the well, which prevents production causing significant delays and substantial costs.

It is an object of the present invention to provide an automatic blanking completion tool which overcomes or at least mitigates disadvantages of the prior art.

SUMMARY OF THE INVENTION

According to a first aspect of the present invention there is provided an automatic blanking completion tool comprising: a body having an inlet and first and second outlets, the outlets being arranged in parallel and opposite the inlet; a support member located between the outlets; a sealing element mounted on the support member and rotatable with respect to the support member, the element including a substantially spherical surface; and wherein the support member is pivoted between the outlets to bring the sealing element into contact with either outlet and thereby selectively seal the respective outlet and prevent fluid flow therethrough.

As the sealing element can freely rotate, a fresh sealing surface is provided every time the element comes into contact with an outlet. In this way, the disadvantages of wear on the faces of the prior art flapper valve are overcome.

In an embodiment, the sealing element is a wheel arranged to rotate on its axle. More particularly, the wheel is formed from a sphere from which portions are removed to provide two opposing faces of circular cross-section, with the axle being centrally located on and arranged perpendicular to the surfaces. In this way, the rim of the wheel presents a substantially spherical surface, which rotates around the axle.

In an embodiment, the support member comprises a quadrilateral frame having a first side arranged between the outlets which can pivot about a first axis. More particularly, the axle of the sealing element is at a second side of the frame, opposite the first side. The second side of the frame may comprise two opposing rounded pins locating in recesses centrally located on either side of the wheel. Alternatively, the opposing rounded pins may be ends of a spindle being the axle of the wheel, which rotate in retainers on the third and fourth sides of the frame, respectively. In this way, a yoke is provided in which the sealing element is both supported and free to rotate.

In another embodiment, the support member may comprise a first member arranged between the outlets which can pivot about a first axis, a second member perpendicular to the first and including a head being encompassed and retained within the sealing element. In this embodiment the sealing element may rotate relative to the second member.

In an embodiment, each outlet includes a valve seat into which a portion of the spherical surface can mate. More particularly the valve seat is of circular cross-section and conical, to provide a circumferential seal with the sealing element.

In an embodiment, the sealing element is retained on the support member with a loose tolerance. In this way, the sealing member exhibits 'play' as it rotates relative to the support member. In another embodiment, the sealing element is self-centring when it engages the outlet. In this way, the sealing performance of the tool is improved.

In an embodiment, the support member is spring biased to a first position. Particularly the spring bias is provided by a plurality of torsion springs. More particularly, the support member can pivot to rotate through 180 degrees. This is required when the outlets are side by side at the same vertical position in the tool. In another embodiment, the outlets may be arranged at an acute angle with respect to each other. In this way, the support member pivots through a rotation of less than 180 degrees. Such an arrangement requires a lower differential pressure across the sealing element to operate the tool.

In an embodiment, the inlet is connected to production tubing, the first outlet is connected an ESP and the second outlet connected to bypass tubing. In this way the present invention prevents the re-circulation of fluids in the well. More particularly, the inlet and second outlet are co-linear to provide a through bore to bypass tubing. This allows logging operations to be performed below the ESP.

In an alternative embodiment pumps may be arranged on tubing at both the first and second outlets. This provides controlled operation of the blanking tool by being able to adjust the pressure-differential across the sealing element.

BRIEF DESCRIPTION OF THE DRAWINGS

Embodiments of the present invention will now be described, by way of example only, with reference to the accompanying figures where.

DETAILED DESCRIPTION

Figure 1:
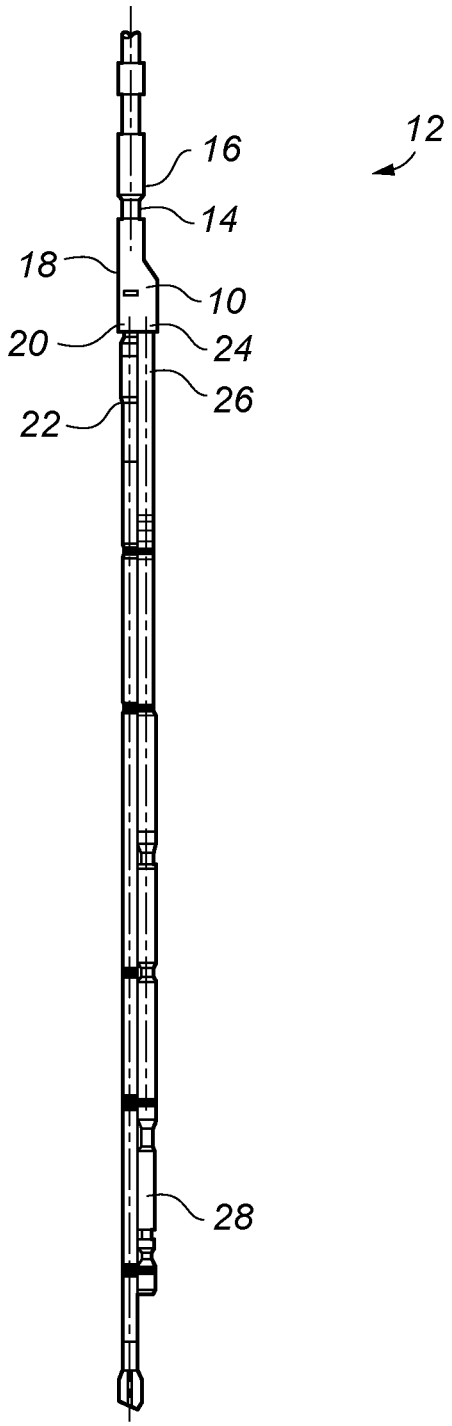
FIG. 1 is a schematic illustration of a completion system including an automatic blanking completion tool according to an embodiment of the present invention.

Reference is initially made to FIG. 1 of the drawings which illustrates an automatic blanking completion tool, generally indicated by reference numeral 10, located within an ESP completion system 12, for operating in a well bore according to an embodiment of the present invention.

The tool 10 has an inlet 14 which is connected to production tubing 16, the tubing 16 supporting the tool 10. Opposite the inlet 14 on the tool body 18 is a first outlet 20, connected to bypass tubing 22. This provides a continuous vertical through bore so that wireline, coiled tubing or other strings can be run through the tool 10 into the tubing 22. Adjacent to the first outlet 20 is a second outlet 24 from which is hung ESP tubing 26 which terminates with an ESP 28. This arrangement provides an ESP completion system 12, which allows for the lifting of well fluids via the ESP 28 while providing bypass tubing for access of tools for logging and other intervention below the ESP 28.

Figure 2:
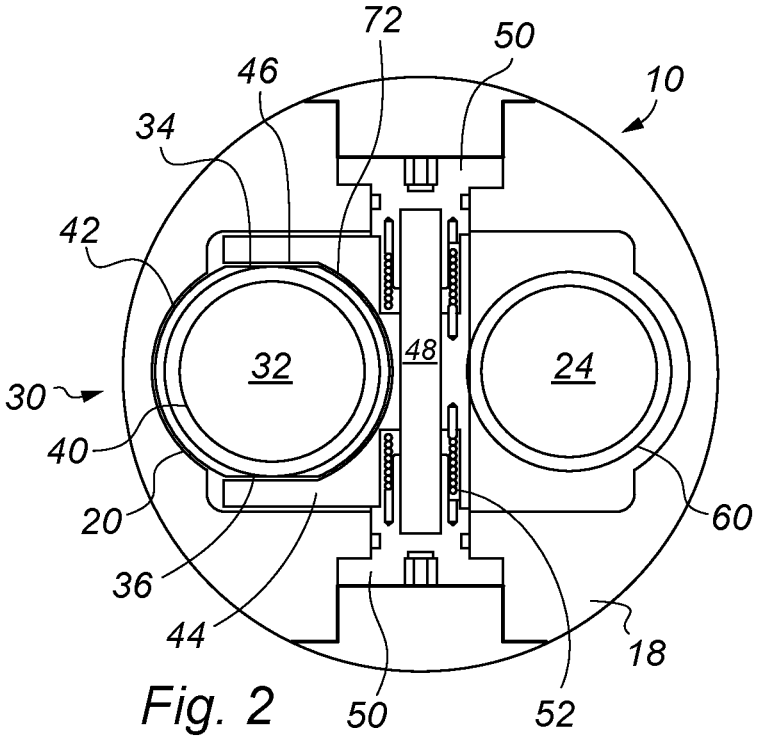
FIG. 2 is a cross-sectional view of an automatic blanking completion tool according to a first embodiment of the present invention.
Figure 3:
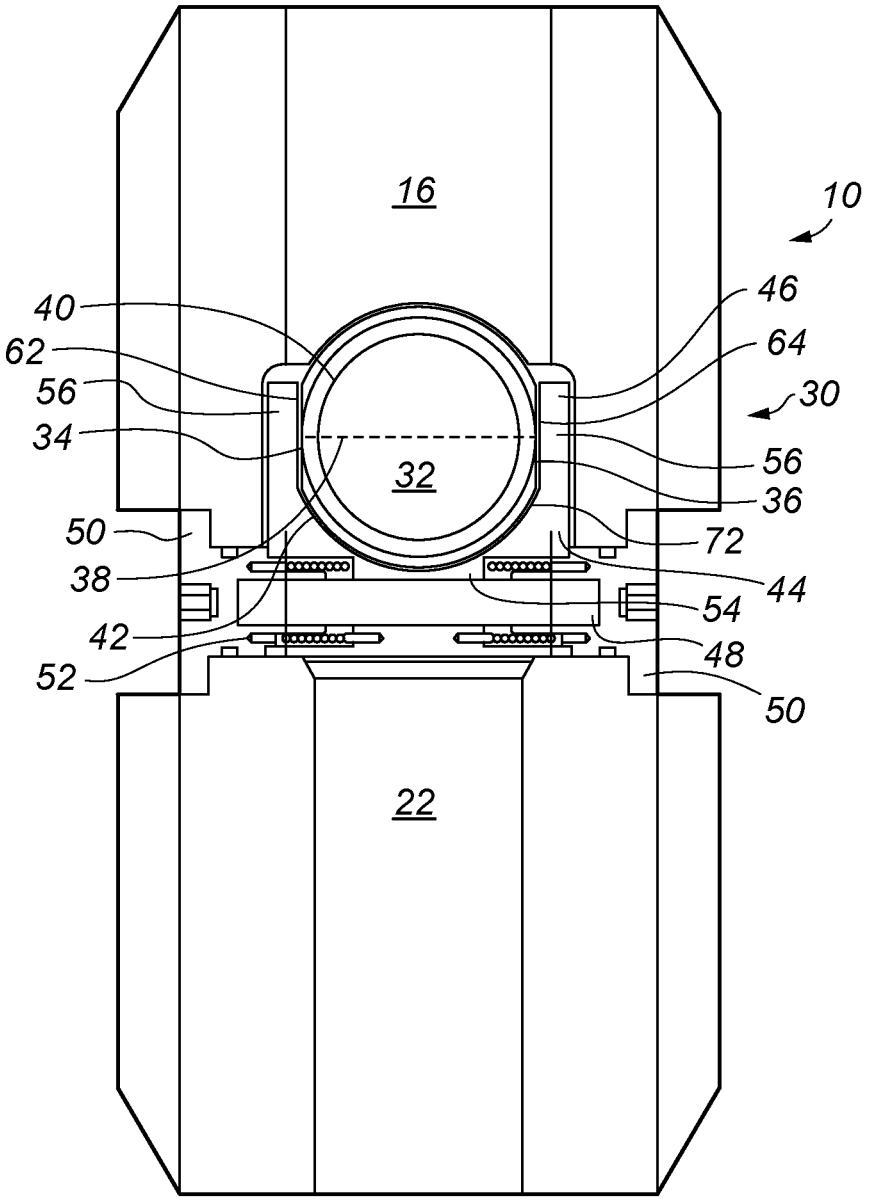
FIG. 3 is the automatic blanking completion tool of FIG. 4 shown in an alternative cross-section.

Referring now to FIGS. 2 and 3 there are illustrated cross-sectional views through the tool 10, according to an embodiment of the present invention. In FIG. 2, the view is down upon the first 20 and second 24 outlets arranged in the cylindrical tool body 18, while FIG. 3 shows the longitudinal view through the tool 10 between the production tubing 16 and the bypass tubing 22. Located between the outlets 20,24 across the tool body 18, is a support, generally indicated by reference numeral 30. The support holds a sealing element 32.

The sealing element 32 resembles a sphere which has been spliced to create two opposing faces 34,36 by removing portions of the sphere. Each face 34,36 thus appears as a circular planar surface. By considering an axis through the element between the centres of the faces 34,36 as an axle 38, about which the element 32 can rotate, a wheel 40 is created having a circular rim presenting a substantially spherical surface 42. The surface 42 is smooth and continuous to create a seal.

The sealing element 32 is held in a support 44 which is arranged between the outlets 20,24. The support comprises a frame 46 located upon a cylindrical spindle 48. The spindle 48 is located between a pair of mounts 50 and held so that it can rotate within the mounts 50 and with it rotate the frame 46. Torsion springs 52 are arranged between the mounts 50 and frame 46 to bias the frame 46 into a first position over the second outlet 24 above the ESP 28.

The frame 46 resembles a yoke, having a substantially rectangular arrangement with a base 54 which is mounted on the spindle 48. The frame 46 has sides 56,58 extending from the base 54 to the axle 38 of the sealing element 32. At the axle 38 is the 'fourth' side of the frame 46. In an embodiment, cylindrical protrusions from the sides 56,58 locate in cylindrical recesses on each face 34,36. In this way, the sealing element 32 is supported on the protrusions while being able to freely rotate about the axle 38. In an alternative embodiment, cylindrical protrusions are provided on the axle 38 extending from the centres of each of the faces 34,36. Complimentary recesses are formed in the sides 56,58. In this way, the sealing element 32 is supported on the sides 56,58 while being able to freely rotate about the axle 38.

Each outlet 20,24 is defined at the end of the respective tubing 22,26 and the body 18. Each outlet 20,24 presents a circular orifice. At the orifice, the edge is cut away to provide a part conical structure at the opening to the orifice. The sloping conical surface 60 provides an improved sealing surface upon which the spherical surface 42 of the sealing element 32 can provide a seal when they come into contact. Thus a valve seat is effectively formed at each outlet 20,24.

In an embodiment, a space is provided between each face 34,36 of the wheel 40 and the inner surfaces 62,64 of the sides 56,58. The space provides for 'play' of the wheel 40 between the sides 56,58. This side to side travel is supported by the protrusions. Additionally, the diameter of the protrusions is machined with low tolerance in respect to the recesses, so that the diameter of the protrusions is less than the diameter of the recesses and thus the wheel 40 can move laterally in any direction aside from rotating in the frame 46. This movement assists in allowing the sealing element 32 to effectively 'self-seat' or 'self-centre' when the wheel 40 is brought towards the conical surface 60.

In use, the ESP completion system 12 including the automatic blanking completion tool 10 is run into a well bore. During run in, fluids will be forced up the bypass tubing 22 and the ESP tubing 26. Subsequently, the fluid pressures at the outlets 20,24 will be comparable which will push the frame 46 into a vertical position due to the pressure applied to both halves of the sealing element 32. Indeed any variation is likely to only cause the wheel 40 to rotate on the axle 38. In this mode, all fluid is forced up the inlet 14 and through the production tubing 16.

If the well fluids have insufficient pressure to rise in the tubing, the pressure at the outlets 20,24 will reduce to a level where the bias on the torsion springs will rotate the frame 46 on the spindle 48 until the sealing element 32 meets the outlet 24 on the ESP tubing 26. A seal is created by the spherical surface 42 being brought onto the conical surface 60. In an embodiment the sealing element 32 will self-align as it meets the conical surface 60. The seal will be formed by whichever points (which form a circle) on the surface 42 of the wheel 40 are facing the surface 60 at the time of contact. As the wheel 40 is both free to rotate and will rotate with the flow of fluid pressure, this circle of points will change each time the spherical surface 42 meets a conical surface 60. As there are an infinite number of positions which form a circle of points on the surface 42, the sealing element 32 is not prone to wear at particular points on the surface 42, like the flapper, and thus is less likely to be eroded or misshapen through use.

With the sealing element 32 now making sealing contact with the outlet 24 at the conical surface 60, the ESP tubing is sealed from the tool body 18. Consequently, fluids which will now wish to travel down into the well bore are diverted through the bypass tubing 22 and such reverse circulation is prevented from occurring through the ESP 28 which prevents damage to the ESP 28.

Figure 4:
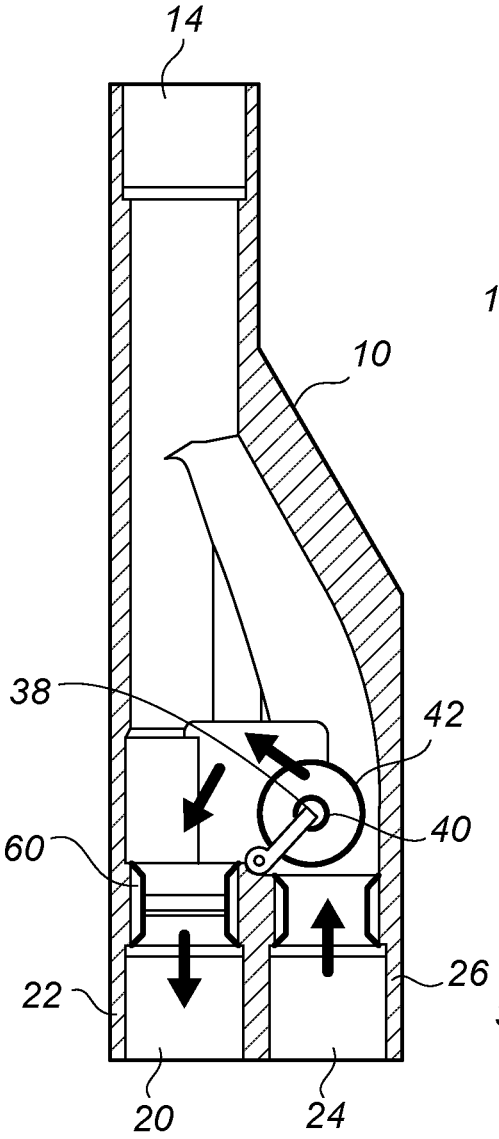
FIG. 4 a cross-sectional view through an automatic blanking completion tool with the support member moving between the outlets.

With the ESP 28 in position, production can be taken from the well bore by the operation of the ESP 28. The ESP artificially lifts the well fluids by pumping them up the ESP tubing 26. On reaching the sealing element 32, fluid pressure will break the seal between the spherical surface 42 and the conical surface 60, lifting the wheel 40 from the outlet 24. The continuous fluid pressure will force the frame 46 to rise, being rotated on the spindle 48, as illustrated in FIG. 4. The fluid flow direction is marked on with arrows.

Figure 5:
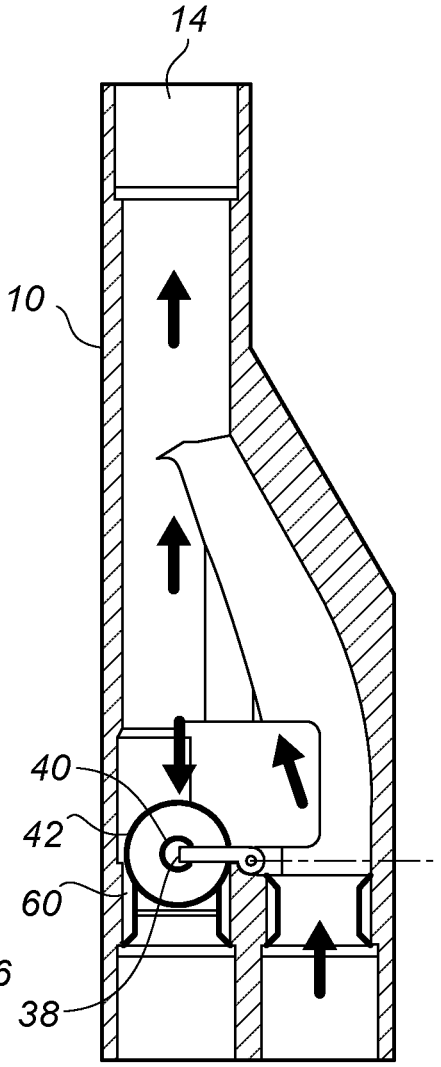
FIG. 5 is the automatic blanking completion tool of FIG. 2 with the sealing element over an outlet.

Initially, as the fluid pressure is only sufficient to lift the fluids to the tool 10, the fluid will recirculate to the well through outlet 20 and the bypass tubing 22. With sufficient pressure, and the bias on the torsion springs 52, the support 44 is rotated so that the frame 46 is brought over the first outlet 20. It will be apparent that the wheel will likely be rotating throughout this manoeuvre, so that a fresh circle of points on the spherical surface 42 is presented onto the conical surface 60 of the first outlet 20 to form a seal. With the first outlet sealed so that fluids are prevented from being re-circulated into the well, all production is pumped through the inlet 14 and up the production tubing 16 to surface. This movement of fluid maintains the seal at the outlet 20. This arrangement is illustrated in FIG. 5.

When access is required to the bypass tubing 22 for intervention purposes such a logging operations below the ESP, the sealing element 32 can be automatically removed from the outlet 20, by turning off the ESP. On turning off the ESP, well fluids are no longer pumped up the ESP tubing 26, with the result that pressure will drop in the tool body 18 and particularly on the sealing element 32. With the pressure drop the torsion springs 52 will have sufficient force to rotate the frame 46 on the spindle 48 and bring the wheel 40, through 180 degrees to lie over the outlet 24. If the pressure change and/or bias is sufficient to seal the element 32 on the conical surface 60 of the outlet 24, then fluid is prevented from being recirculated through the ESP and any potential damage to the ESP is prevented. Again, as the wheel will rotate under the influence of fluid movement, a fresh circle of points on the spherical surface 42 is presented onto the conical surface 60 of the second outlet 24, thereby increasing the useful life of the sealing element 32.

If the support 44 does not fully rotate to seat on the outlet 24, tools run through the production tubing 16 and into the tool body 18 via the inlet 14, will naturally push the support 44 out of the way towards the ESP tubing 26, as any the leading edge of the inserted string will make contact with the wheel 40. On contacting the wheel 40, the downward pressure will merely cause the wheel 40 to rotate counter-clockwise upon its axle 38 while being pushed aside. This will provide no resistance to the inserted string, wireline or coiled tubing. In this way, if the springs 52 are not providing sufficient bias, they will not cause a malfunction sufficient to prevent logging operations as may occur for the prior art flapper valve arrangement.

Once intervention is complete, production can be started again by merely switching on the ESP, to resume the pumping of fluids up the ESP tubing 26, with the support 44 returning to seal the first outlet 20 as described above.

Figure 6:
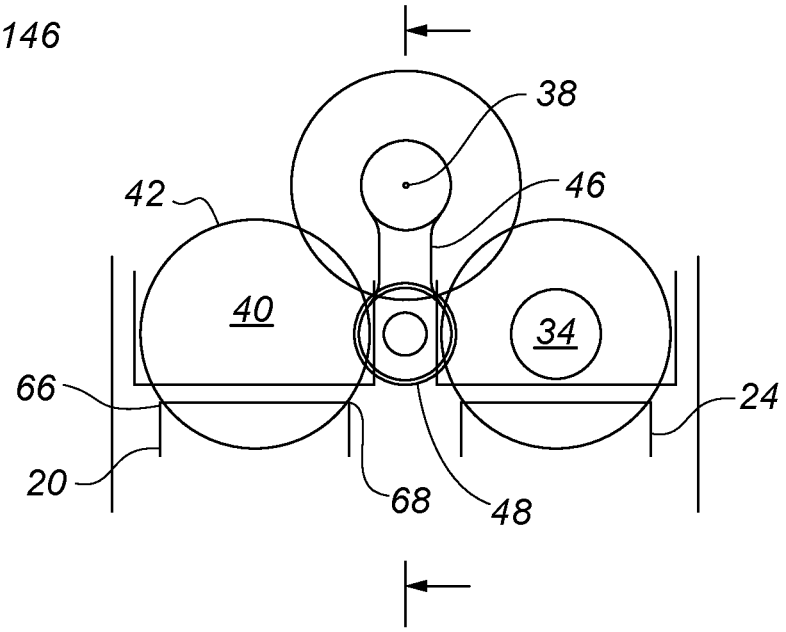
FIG. 6 is a schematic illustration of the sealing element positions of the automatic blanking completion tool of FIG. 4.

The smooth movement of the wheel 40 throughout these operational steps is illustrated in FIG. 6. Shown in schematic cross-section, the wheel 40 is arranged such that seal points 66,68 are made on the outlets 20,24. The seal points are related via a chord 70, which equals the diameter of the bypass 22 or production 16 tubing respectively. As the wheel 40 can rotate freely on the axle 38 in the centre of the face 34, an almost infinite number of chords can be determined within the circumference or rim of the wheel 40. This illustrates the multiple available fresh sealing points which will be made each time the wheel 40 is brought into contact with an outlet 20,24. Indeed, if for any reason it was felt that a suitable seal had not been formed, it is a simple matter of switching on or off the ESP accordingly for a sufficient time to merely break the seal and lift the wheel 40 off the conical surface 60. The movement of fluid passed the wheel 40 through the outlet 20,24 will cause rotation of the wheel 40 and when the ESP is returned to its operating mode a fresh set of sealing points will make the seal between the sealing element 32 and the outlet 20,24. The internal edge 72 of the frame 46 (see FIG. 5) can also be rounded to match the outer diameter of the wheel 40 so that any debris adhering to the spherical surface 42 will be dislodged as the wheel 40 passes the edge 72 when it rotates relative to the frame 46.

Figure 7:
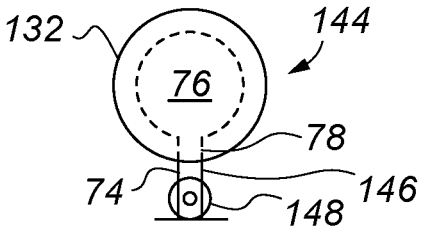
FIG. 7 is a cross-sectional view of a support member and sealing element of an automatic blanking completion tool according to a second embodiment of the present invention.

Reference is now made to FIG. 7 of the drawings which illustrates an alternative embodiment of the support 44. Like parts to those of the earlier Figures will be given the same reference numeral with the addition of 100 to aid clarity. Support 144 is provided with a spindle 148 and a frame 146. The spindle 148 will be similar to the first embodiment so that it can be supported and rotate within mounts 150 (not shown). The frame 146 is connected to the spindle 148 as before, but now comprises a cylindrical shaft 74 extending from the spindle 148 and terminating at a head 76. Surrounding the head 76 is the sealing element 132. The sealing element 132 is a spherical member having a circular aperture 78 through which the shaft 74 extends. The shape of the head 76 is selected so that the element 132 can rotate freely around the shaft 74. Some tolerance may be selected to give 'play' between the components so that the sealing element 132 can self-centre in the same fashion as the first embodiment.

It will be understood that while the description has been provided for a tool 10 with bypass tubing and ESP tubing depending from each outlet, ESP tubing may depend from both outlets. In this arrangement by sequencing the operation of the ESP's the fluid pressure can be controlled at the tool body to effect the rotation of the support and consequently the respective sealing of the desired ESP tubing. Thus, recirculation is prevented through each ESP when the alternative ESP is switched on.

An advantage of embodiments of the present invention is that it provides an automatic blanking completion tool which presents a fresh surface for sealing an outlet of the tool each time a seal is required.

Various modifications may be made to the invention herein described without departing from the scope thereof. For example, other arrangements for supporting the sealing element may be used which still allow the sealing element to rotate with respect to the support, and the support to rotate with respect to the body.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A blanking completion tool comprising:

a body having an inlet and a first outlet and a second outlet, the first and second outlets being arranged in parallel and opposite the inlet, wherein the first outlet and the second outlet comprises a circular orifice, and wherein each orifice comprises a sloping conical surface;

a support member located between the outlets;

a sealing element mounted on the support member and rotatable with respect to the support member, the element including a substantially spherical surface; and wherein the support member is pivoted between the outlets to bring the sealing element into contact with the sloping conical surface of one of the outlets and thereby selectively seal the respective outlet and prevent fluid flow therethrough.

2. A blanking completion tool according to claim 1 wherein the sealing element comprises a wheel arranged to rotate on an axle of the sealing element.

3. A blanking completion tool according to claim 2 wherein the wheel is formed from a sphere from which portions are removed to provide two opposing faces of circular cross-section, with the axle being centrally located on and arranged perpendicular to the faces.

4. A blanking completion tool according to claim 1 wherein the support member comprises a quadrilateral frame having a first side arranged between the outlets which can pivot about a first axis.

5. A blanking completion tool according to claim 4 wherein the sealing element comprises a wheel arranged to rotate on an axle of the sealing element and the axle is at a second side of the frame, opposite the first side.

6. A blanking completion tool according to claim 5 wherein the second side of the frame comprises two opposing rounded pins locating in recesses centrally located on either side of the wheel.

7. A blanking completion tool according to claim 5 wherein the second side of the frame comprises two opposing rounded pins which are ends of a spindle being the axle of the wheel, which rotate in retainers on third and fourth sides of the frame, respectively.

8. A blanking completion tool according to claim 1 wherein the support member comprises a first member arranged between the outlets which can pivot about a first axis, a second member perpendicular to the first member and including a head being encompassed and retained within the sealing element.

9. A blanking completion tool according to claim 8 wherein the sealing element rotates relative to the second member.

10. A blanking completion tool according to claim 1 wherein the sloping conical surface of each circular orifice comprises a valve seat into which a portion of the spherical surface can mate.

11. A blanking completion tool according to claim 10 wherein the valve seat is of circular cross-section and conical, to provide a circumferential seal with the sealing element.

12. A blanking completion tool according to claim 1 wherein the sealing element is retained on the support member with a loose tolerance.

13. A blanking completion tool according to claim 1 wherein the sealing element is self-centering when the sealing element engages one of the outlets.

14. A blanking completion tool according to claim 1 wherein the support member is spring biased to a first position.

15. A blanking completion tool according to claim 14 wherein the spring bias is provided by a plurality of torsion springs.

16. A blanking completion tool according to claim 1 wherein the outlets are side by side at the same vertical position in the tool and the support member pivots to rotate through 180 degrees.

17. A blanking completion tool according to claim 1 wherein the outlets are arranged at an acute angle with respect to each other and the support member pivots through a rotation of less than 180 degrees.

18. A blanking completion tool according to claim 1 wherein the inlet is connected to a production tubing, the first outlet is connected to an electrical submergible pump and the second outlet is connected to a bypass tubing.

19. A blanking completion tool according to claim 18 wherein the inlet and second outlet are co-linear to provide a through bore to the bypass tubing.

20. A blanking completion tool according to claim 18 wherein the second outlet is connected to an electrical submergible pump arranged on the bypass tubing.

* * * * *